US005735622A

United States Patent [19]

Melnick et al.

[11] Patent Number: 5,735,622

[45] Date of Patent: Apr. 7, 1998

[54] WRITING INSTRUMENT WITH A COMPRESSIBLE FRICTION COATING AND METHOD OF MAKING

[75] Inventors: Norman Melnick, Edison; David Warren Melnick, Holmdel, both of N.J.

[73] Assignee: Pentech International Inc., Edison, N.J.

[21] Appl. No.: 599,393

[22] Filed: Dec. 14, 1995

[51] Int. Cl.[6] ..... B43K 19/14

[52] U.S. Cl. ..... 401/96; 401/88

[58] Field of Search ..... 401/96, 88, 6

[56] References Cited

U.S. PATENT DOCUMENTS

| | | | |
|---|---|---|---|
| H1050 | 5/1992 | Petrillo . | |
| Re. 11,259 | 8/1892 | Goldsmith | 401/96 |
| D. 252,757 | 8/1979 | Sublette . | |
| D. 307,444 | 4/1990 | Poisson et al. . | |
| D. 310,101 | 8/1990 | Gauthier . | |
| 330,019 | 11/1885 | Hamann | 401/96 |
| D. 338,039 | 8/1993 | Takahashi . | |
| D. 338,915 | 8/1993 | Willat . | |
| 500,061 | 6/1893 | Goldsmith | 401/96 |
| 597,942 | 1/1898 | Blend . | |
| 606,551 | 6/1898 | Huffman . | |
| 798,749 | 9/1905 | Rose . | |
| 1,502,763 | 7/1924 | Bugbee . | |
| 1,504,209 | 8/1924 | Bugbee . | |
| 1,718,831 | 6/1929 | Nordrum . | |
| 1,920,005 | 7/1933 | Daneke | 401/96 |
| 2,173,451 | 9/1939 | Lorber . | |
| 2,231,410 | 2/1941 | Kern et al. . | |
| 2,318,171 | 5/1943 | Lipic, Jr. . | |
| 2,372,914 | 4/1945 | Schweitzer . | |
| 2,734,838 | 2/1956 | Clancy et al. . | |
| 2,988,784 | 6/1961 | Lorenian . | |
| 3,308,939 | 3/1967 | Sakalys . | |
| 3,520,627 | 7/1970 | Suzuki . | |
| 3,674,721 | 7/1972 | Aufdermarsh, Jr. et al. | 525/63 AC |
| 3,704,071 | 11/1972 | Muller et al. | 401/96 |
| 3,764,577 | 10/1973 | Burns et al. | 260/45.7 P |
| 3,787,898 | 1/1974 | Walker . | |
| 3,875,088 | 4/1975 | Arons et al. . | |
| 3,892,585 | 7/1975 | Sagane | 106/187 |
| 3,989,662 | 11/1976 | Schmitt et al. | 260/31.2 N |
| 3,993,408 | 11/1976 | Arons et al. | 401/96 |
| 4,123,179 | 10/1978 | Pacheco . | |
| 4,176,978 | 12/1979 | Ruzicka et al. . | |
| 4,413,921 | 11/1983 | Fotiu et al. . | |
| 4,490,415 | 12/1984 | Imamura et al. . | |
| 4,640,636 | 2/1987 | Hoffman . | |
| 4,743,653 | 5/1988 | Numatta et al. | 525/125 |
| 4,913,972 | 4/1990 | Grunewalder et al. | 428/425.5 |
| 4,983,671 | 1/1991 | Numata et al. | 525/63 |
| 5,334,246 | 8/1994 | Pietrzykowski et al. . | |
| 5,354,834 | 10/1994 | Yoshida et al. | 528/59 |

FOREIGN PATENT DOCUMENTS

| | | | |
|---|---|---|---|
| 0325923 | 8/1989 | European Pat. Off. . | |
| 2416327 | 10/1974 | Germany | 401/96 |
| 1623879 | 1/1991 | U.S.S.R. | 401/96 |

*Primary Examiner*—Steven A. Bratlie
*Attorney, Agent, or Firm*—Sperry, Zoda & Kane

[57] ABSTRACT

An improved writing instrument and method for manufacture thereof wherein a coating of a varnish mixture including a hardening component is applied by spraying or dipping or being force fed through a lacquer pot and squeegee to coat the external housing of the writing instrument to provide it with a compressible polyurethane friction coating thereon which is soft to grasp to greatly facilitate grasping and holding thereof. The compressible friction coating is more compressible than the conventional plastic, wood or composite material normally used for the external housing of a writing instrument such as a pen or pencil and provides a high friction surface to facilitate grasping and aid in accurately writing or drawing as desired. The external housing can include one or two coatings of the compressible polyurethane friction coating such as to provide additional compressibility thereof. The coating forms a non-slip friction surface on the external housing of the writing instrument to provide a soft, luxurious, compressible feel to the writing instrument itself during use thereof.

48 Claims, 4 Drawing Sheets

STATIC COEFFICIENT OF FRICTION[1] DETERMINED FOR PENCIL MATERIALS WITH SELECTED COATINGS

| MATERIAL | SPECIMEN NUMBER | STATIC COEFFICIENT OF FRICTION |
|---|---|---|
| CONTROL | 1 | 0.344 |
| | 2 | 0.384 |
| | 3 | 0.306 |
| MEAN | | 0.338 |
| COATING A | 1 | 0.601 |
| | 2 | 0.532 |
| | 3 | 0.577 |
| MEAN | | 0.570 |
| COATING B | 1 | 0.509 |
| | 2 | 0.532 |
| | 3 | 0.509 |
| MEAN | | 0.517 |

[1]CONDUCTED AT AMBIENT CONDITIONS

*Fig. 8*

WRITING INSTRUMENT WITH A COMPRESSIBLE FRICTION COATING AND METHOD OF MAKING

BACKGROUND OF THE INVENTION

1. Field of the Invention

The present invention applies to the general field of writing instruments which are normally used for drawing, writing, sketching, coloring or other common activities. The present invention provides a more comfortable novel means to facilitate holding of such writing instruments by the direct application of a coating thereon which provides a compressible non-slip surface. Prior art devices have been designed which are adapted to extend around writing instruments for various reasons. However, most of these configurations are really external appliances which are easily removable. The present invention, however, provides a coating applied during manufacture which chemically adheres to the surface of the writing instrument and, as such, is bonded thereto.

2. Description of the Prior Art

Prior art devices for showing methods of manufacture of writing instruments and showing improved writing instruments have been granted for a number of years. The closest patents to the apparatus of the present invention are such as those shown in U.S. Pat. No. 597,942 issued Jan. 25, 1898 to W. Blend on a "Penholder"; and U.S. Pat. No. 606,551 issued Jun. 28, 1898 to W. Huffman on a "Rubber Attachment For Pencils"; and U.S. Pat. No. 798,749 issued Sep. 5, 1905 to A. Rose on a "Covered Pen, Pencil, . . ."; and U.S. Pat. No. 1,502,763 issued Jul. 29, 1924 to L. Bugbee on a "Pencil And Process Of Making The Same"; and U.S. Pat. No. 1,504,209 issued Aug. 12, 1924 to L. Bugbee on a "Pencil And Process Of Making The Same"; and U.S. Pat. No. 1,718,831 issued Jun. 25, 1929 to G. Nordrum and assigned to Henry G. Nordrum (⅓) and J. W. Hamilton (⅓) on an "Attachment For Writing Instruments"; and U.S. Pat. No. 2,173,451 issued Sep. 19, 1939 to C. Lorber and assigned to Charles Lorber and Winfield R. Offutt on a "Finger Fitting Holder"; and U.S. Pat. No. 2,231,410 issued Feb. 11, 1941 to E. Kern et al on a "Cushioned Lead Pencil"; and U.S. Pat. No. 2,318,171 issued May 4, 1943 to J. Lipic, Jr. and assigned to Jos. Lipic Pen Co. on a "Holder For Pencils And The Like"; and U.S. Pat. No. 2,372,914 issued Apr. 3, 1945 to A. Schweitzer on a "Pencil Lead Writing Utensil"; and U.S. Pat. No. 2,734,838 issued Feb. 14, 1956 to J. Clancy et al and assigned to Arthur D. Little, Inc. on "Wrapped Pencil-Shaped Articles And Method Of Making Same"; and U.S. Pat. No. 2,988,784 issued Jun. 20, 1961 to Z. Lorenian on the "Manufacture Of Pencils And Other Shaped Articles"; and U.S. Pat. No. 3,308,939 issued Mar. 14, 1967 to S. Sakalys and assigned to Brier Manufacturing Company on a "Plastic Lipstick Holder"; and U.S. Pat. No. 3,520,627 issued Jul. 14, 1970 to Y. Suzuki and assigned to Mitsubishi Pencil Company Limited on a "Writing Instrument"; and U.S. Pat. No. 3,787,898 issued Jan. 29, 1974 to C. Walker on a "Writing Facilitating Glove"; and U.S. Pat. No. 3,875,088 issued Apr. 1, 1975 to I. Arons et al and assigned to Hasbro Industries, Inc. on "Pencil Sheath Compositions"; and U.S. Pat. No. 4,123,179 issued Oct. 31, 1978 to N. Pacheco on an "Orthopedic Finger Piece For Writing Instruments"; and U.S. Pat. No. Des. 252,757 issued Aug. 28, 1979 to O. Sublette on a "Pen"; and U.S. Pat. No. 4,176,978 issued Dec. 4, 1979 to J. Ruzicka et al on a "Pencil Sheath And Composition Therefor"; and U.S. Pat. No. 4,413,921 issued Nov. 8, 1983 to E. Fotiu et al and assigned to Revlon, Inc. on a "Cosmetic Pencil Having A Sharpenable Polyethylene Casing"; and U.S. Pat. No. 4,490,415 issued Dec. 25, 1984 to K. Imamura et al and assigned to Asahi Kasei Kogyo Kabushiki Kaisha on a "Method Of Coating A Pencil"; and U.S. Pat. No. 4,640,636 issued Feb. 3, 1987 to H. Hofmann and assigned to Schwan-Stabilo Schwanhausser GmbH & Co. on a "Powder Stick With Shrink Film Sheathing"; and U.S. Pat. No. Des. 307,444 issued Apr. 24, 1990 to N. Poisson et al and assigned to The Gillette Company on a "Grip Portion For A Writing Instrument"; and U.S. Pat. No. Des. 310,101 issued Aug. 21, 1990 to R. Gauthier and assigned to Deidre Stanley on a "Combination Cover And Holder For Writing Instrument"; and United States Statutory Invention Registration No. H1050 published May 5, 1992 to R. Petrillo and assigned to The Gillette Company on a "Writing Instrument"; and U.S. Pat. No. Des. 328,759 issued Aug. 18, 1992 to R. Pozil et al on a "Writing Aid"; and U.S. Pat. No. Des. 338,039 issued Aug. 3, 1993 to O. Takahashi and assigned to Kotobuki & Co., Ltd. on a "Writing Instrument"; and U.S. Pat. No. Des. 338,915 issued Aug. 31, 1993 to B. Willat on a "Writing Instrument"; and U.S. Pat. No. 5,334,246 issued Aug. 2, 1994 to S. Pietrzykowski, Jr. et al and assigned to Xerox Corporation on a "Dip Coat Process Material Handling System"; and U.S. Pat. No. 5,340,610 issued Aug. 23, 1994 to A. Thompson on a "Method Of Splatter Painting A Rotating Object".

SUMMARY OF THE INVENTION

The present invention provides a unique method for the making of writing instrument having a compressible friction coating thereof which is no-slip. The method of manufacture includes the providing of a writing instrument with an external housing and a writing medium conventionally positioned internally therewithin. This construction can comprise a pencil, pen or other similarly configured writing instrument which has the writing medium contained within the generally tubular housing. A varnish component will then be mixed with respect to a hardener component in order to make a fluid varnish mixture. This fluid varnish mixture is applied by coating or dipping to the external housing of the writing instrument to form a coating of the varnish mixture thereon. This varnish mixture is then cured to form a compressible polyurethane friction coating on the external housing of the writing instrument.

Preferably this coating is applied to a thickness of between 0.002 to 0.008 inches. Also multiple coatings can be achieved but most requirements would only necessitate the need for one or two such coatings. These coatings can be applied on the exterior of writing instruments which include plastic, wooden, composite or other materials in the underlying substrate which forms the external housing of the writing instrument.

The curing of the varnish coating can include conventional air drying which can take as long as 24 hours. Alternatively the curing can be expedited by exposing the coated writing instrument to heat such as five minutes of exposure to a temperature of 80–85 degrees Centigrade. This heat can be applied by infrared heating means or any other conventional similar heating apparatus. The actual curing of this varnish coating by heating or air drying preferably includes the evaporating out of some aromatic solvents from within the applied varnish mixture. One of these aromatic solvents commonly evaporated out of such mixtures has been found to be xylol.

Preferably the varnish for forming the initial fluid varnish mixture is chosen from the family of polyester elastomeric materials and preferably the varnish itself includes ester components therein. The hardener for the varnish is preferably chosen from the family of polyisocyanates. A thinner can be added to the varnish mixture for facilitating spraying thereof. Such a thinner would normally not be needed if dipping is the manner of application of the varnish mixture to the external surface of the writing instrument. Thinners are commonly required to facilitate spraying through the spray nozzle of an aspiration means.

Preferably the compressible polyurethane friction coating will have a static resistance of greater than 0.500. This coefficient of static friction will greatly facilitate grasping of the writing instrument by an individual since it is significantly greater than the static coefficient of the external housing of a pen or pencil or of the paint which may be used to coat the external surface of a wooden pencil.

It is an object of the present invention to provide an improved writing instrument and a method for making a writing instrument with a compressible friction coating thereon wherein the compressible friction coating can be applied on substrates of wood, plastic, fiber or any other painted or non-painted substrate which comprises the external housing of the writing instrument.

It is an object of the present invention to provide an improved writing instrument and a method for making a writing instrument with a compressible friction coating thereon wherein a soft feeling compressible varnish coating is applied.

It is an object of the present invention to provide an improved writing instrument and a method for making a writing instrument with a compressible friction coating thereon wherein a soft feeling compressible high friction matt finish can be achieved.

It is an object of the present invention to provide an improved writing instrument and a method for making a writing instrument with a compressible friction coating thereon wherein spraying or dipping can be utilized to apply one or more coatings to the writing instrument.

It is an object of the present invention to provide an improved writing instrument and a method for making a writing instrument with a compressible friction coating thereon wherein if the writing instrument is a conventional pencil it allows sharpening.

It is an object of the present invention to provide an improved writing instrument and a method for making a writing instrument with a compressible friction coating thereon wherein a higher coefficient of static friction occurs on the external surface with less pressure exerted thereon by the user.

It is an object of the present invention to provide an improved writing instrument and a method for making a writing instrument with a compressible friction coating thereon wherein the user can hold the writing instrument in his hand while applying less than the conventional amount of pressure to the external surface of the writing instrument making it easier and more comfortable to hold, preventing callouses and improving handwriting.

It is an object of the present invention to provide an improved writing instrument and a method for making a writing instrument with a compressible friction coating thereon wherein the compressible polyurethane friction coating can be clear, colored or opaque.

It is an object of the present invention to provide an improved writing instrument and a method for making a writing instrument with a compressible friction coating thereon wherein the coating of compressible polyurethane friction will adhere to the external surface of the writing instrument whether it is made of a porous material such as wood or a non-porous material such as plastic or metal.

It is an object of the present invention to provide an improved writing instrument and a method for making a writing instrument with a compressible friction coating thereon wherein a person can grasp a writing instrument much more comfortably.

It is an object of the present invention to provide an improved writing instrument and a method for making a writing instrument with a compressible friction coating thereon wherein a person can grasp a writing instrument having a higher coefficient of static friction to facilitate grasping.

It is an object of the present invention to provide an improved writing instrument and a method for making a writing instrument with a compressible friction coating thereon wherein a person can hold a writing instrument with less fatigue than heretofore.

It is an object of the present invention to provide an improved writing instrument and a method for making a writing instrument with a compressible friction coating thereon wherein writing instruments can be easily personalized.

It is an object of the present invention to provide an improved writing instrument and a method for making a writing instrument with a compressible friction coating thereon wherein a compressible polyurethane friction coating can be applied to a writing instrument after the writing instrument is formed or provided by conventional manufacturing means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 8 is a table showing the measurement of static coefficient of friction for a control sample and for two different coating applications with three specimens tested.

DETAILED DESCRIPTION OF THE PREFERRED EMBODIMENT

Figure 1:
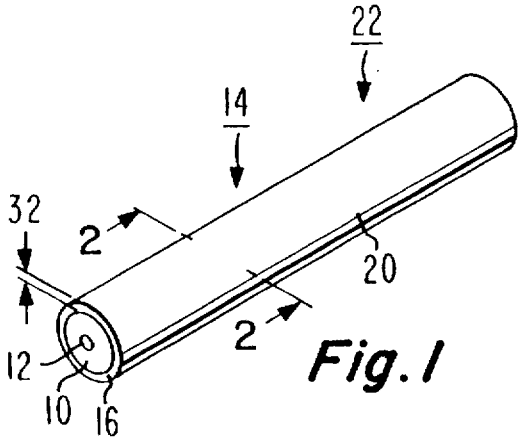
FIG. 1 is a perspective illustration of an embodiment of a pencil manufactured in accordance with the method of the present invention.
Figure 2:
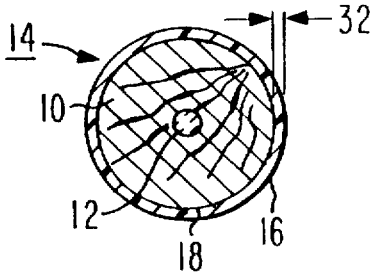
FIG. 2 is a cross-sectional view of FIG. 1 taken through lines 2—2.

The present invention provides a novel means for providing an improved writing instrument and a method for manufacture thereof which may include a pencil housing 10 with a pencil writing medium 12 located axially therein. The pencil 14 preferably has a housing 10 with a generally tubular shape with conventional pencil writing medium 12 such as graphite or the like located centrally therein.

A compressible friction coating 16 is applied to the exterior surface of the pencil to provide a soft, luxurious, compressible coating and feel for the user. This compressible polyurethane friction coating is applied directly to the external surface 18 of the pencil housing 10 or can be applied over a painted pencil housing. In this manner the pencil grasping surface 20 which extends around the outer surface of the pencil will include the compressible friction coating 10 applied thereover. In this manner the feel of the pencil 14 can be controlled by the choice of the configuration or materials and the method of application of the compressible friction coating 16 thereto.

Figure 3:
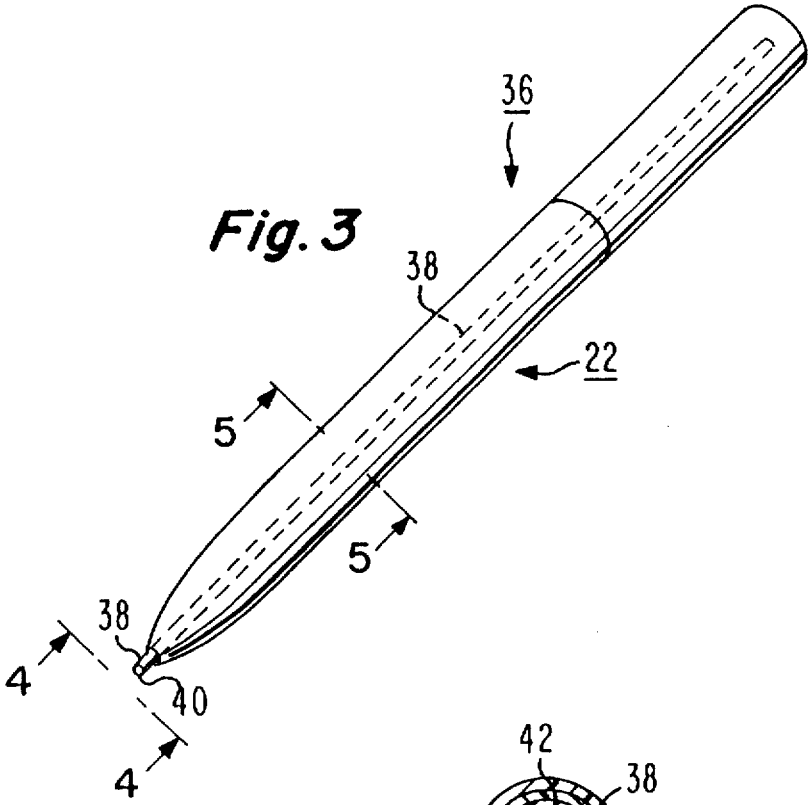
FIG. 3 is a side plan view of an embodiment of a writing instrument of the present invention showing a pen with two compressible polyurethane friction coatings on the external housing thereof.
Figure 4:
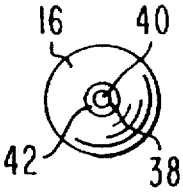
FIG. 4 is an end plan view of FIG. 3 as taken from the lower left.
Figure 5:
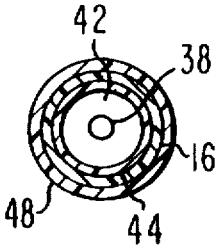
FIG. 5 is a cross-sectional view of FIG. 3 along lines 5—5.

The compressible friction coating 16 of the present invention can be used on any type of writing instrument 22 such as the pen shown in FIG. 3. A conventional pen 36 includes a bore means 34 extending centrally therein with a refill member 38 positioned axially therein. The refill member includes a ball tip 40 at the lowermost end thereof. The body 44 of the pen 36 is normally of a plastic or other material upon which the compressible friction coating 16 can be applied to provide the configuration as shown in FIGS. 4 or 5. Also a second coating 48 can be applied as shown in FIG. 5 to increase the compressibility on the grasping surface of the pen 36.

Figure 6:
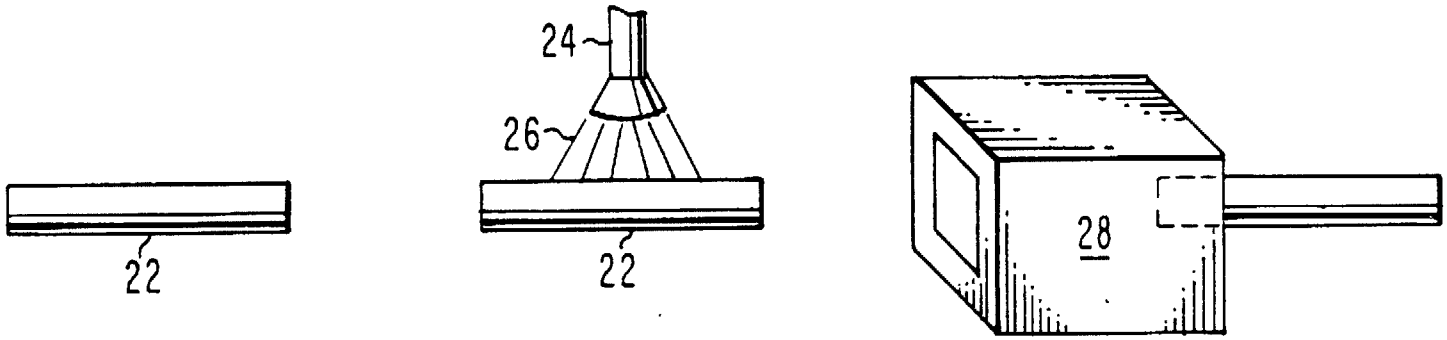
FIG. 6 is a schematic illustration of an embodiment of a method for manufacturing in accordance with the present invention.
Figure 7:
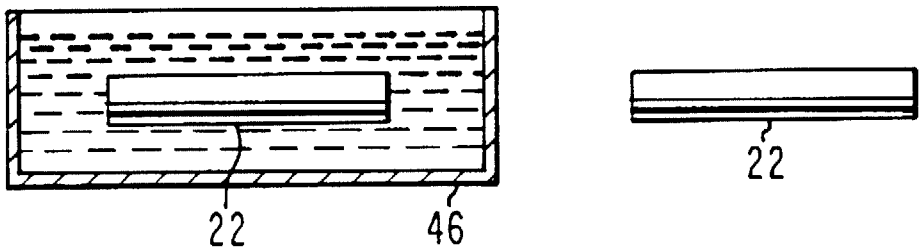
FIG. 7 is an alternative embodiment of the method of manufacture of a writing instrument in accordance with the present invention.

The application of the coating can be achieved by use of a spraying means such as a spray head 24 for dispensing a spray 26 onto the external surface of the writing instrument 22. This liquid coating can then be heated by a heating means 28 such as within the heating chamber 30 to facilitate curing thereof. This configuration is shown schematically in FIG. 6. FIG. 7 depicts an alternative embodiment wherein a vat or pot 46 is utilized. In this configuration the writing instrument 22 is placed into the vat such that the coating extends completely therearound and is thereafter removed for curing. The curing can be air dried for as long as 24 hours or heating within the heating chamber 30 at elevated temperatures.

The method for forming of the compressible friction coating initially includes providing of the writing instrument with an external housing and a writing medium positioned internally therewithin. This configuration would be true whether a pen or pencil or marker is used as the writing instrument upon which the coating is to be applied. A fluid varnish mixture is then achieved by the mixing of a varnish and a hardener component together. This varnish mixture is then applied in the form of a coating on the external housing of a writing instrument. This coating is then cured in such a manner as to form a compressible polyurethane friction coating 16 on the external housing of the writing instrument. Preferably this cured varnish coating will be of a thickness of approximately 0.002 to 0.008 inches as shown by reference numeral 32.

This cured varnish coating can be used regardless of the external housing of the writing instrument which is the substrate to which the coating is applied. This coating has been found to be able to adhere to any substrate whether it is porous like wood or non-porous like plastic or metal.

This adherence is achievable due to the fact that the adherence is a chemical adherence means achieved during curing of the varnish coating.

It has been found that air drying of such a varnish coating normally takes as long as 24 hours at ambient temperature and humidity conditions. Expedited curing can be achieved by immediately exposing of the coated writing instrument 22 to a heating chamber 30 for approximately five minutes at an elevated temperature of 80–85 degrees Centigrade. The actual curing of the varnish mixture coating has been found to allow the evaporating of aromatic solvents therefrom during the actual curing time. Also the varnish coating has been found to evaporate xylol therefrom during curing.

Preferably the varnish used in the varnish mixture is chosen from a family of polyester elastomeric materials and includes aromatic solvents therein.

Preferably the hardener is chosen from the family of polyisocyanates. The hardener preferably has less than 0.9% of free monomers.

In order to facilitate spraying of the mixture of fluid varnish a thinner is normally required which may contain aromatic solvents and esters to facilitate spraying onto the external housing of the writing instrument 22. Such thinners are often required when a mixture is sprayed in order to make the mixture more liquid in order to facilitate aspiration during spraying.

This coating may also include a matting additive to facilitate forming of a compressible polyurethane friction coating with an external matt finish thereon to eliminate loss as desired aesthetically. Also a pigment component can be added to the varnish mixture to form a colored or opaque finally cured varnish coating of compressible poloyrethane material as desired. If such pigments are omitted normally the cured coating will be clear. However, if a designer-type configuration of a writing instrument is desired, the specific pigments can be chosen or opaque components added.

Figure 9:
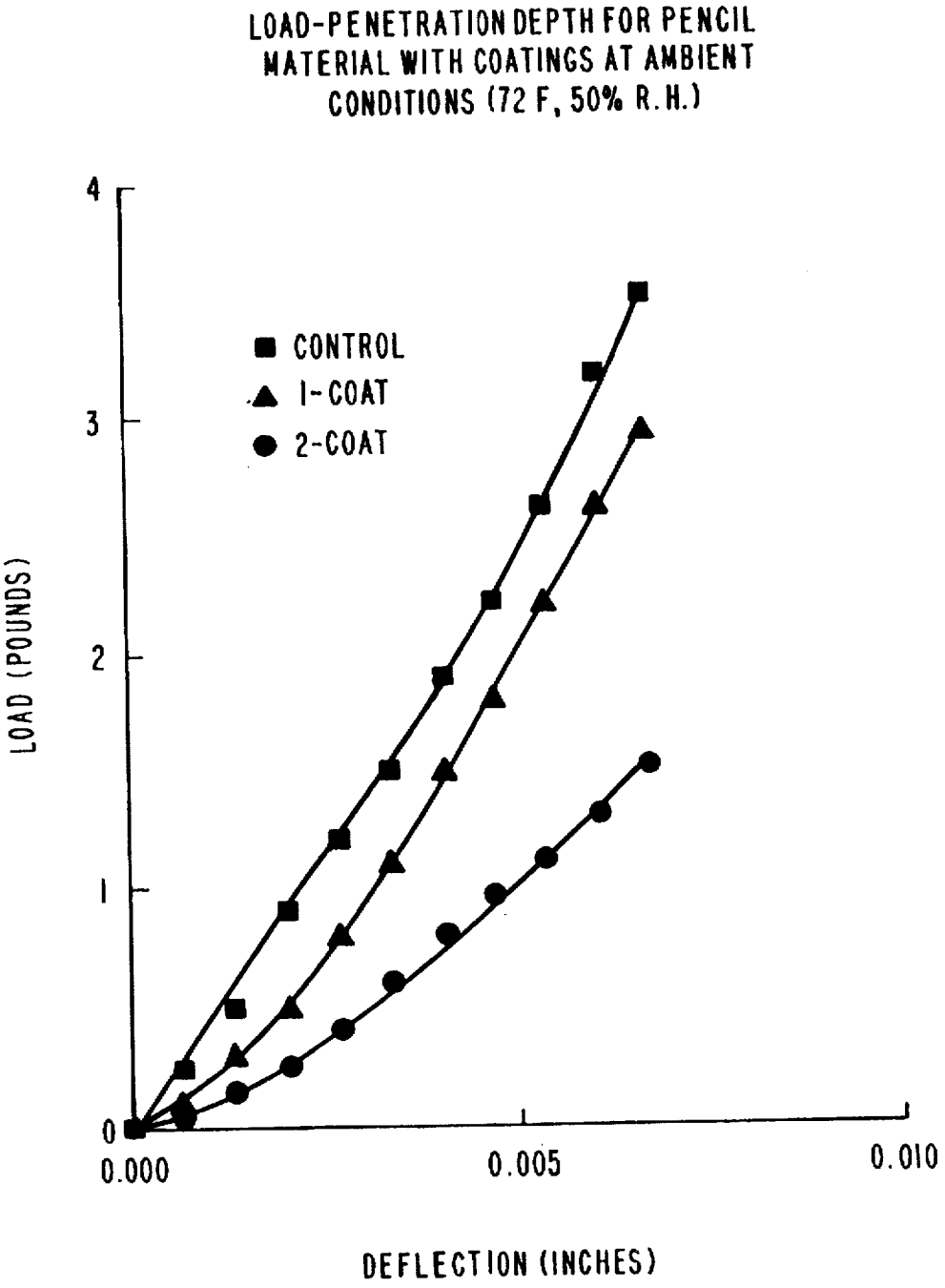
FIG. 9 is a graph showing the measurement of the amount of pressure required for compressing of a writing instrument with no coatings, one coating of polyurethane compressible friction coating and two coatings of polyurethane compressible friction coating.

It should be appreciated that one of the important aspects of the present invention is to increase the compressibility of the grasping surface of the writing instrument 22. The table shown in FIG. 9 clearly shows that the addition of even a single coating of the cured compressible polyurethane friction varnish coating will achieve an increase in the compressibility of this surface and multiple coatings will achieve additional levels of compressibility as also shown in FIG. 9.

The coating applied in accordance with the method of the present invention will also provide a non-slip friction coating on the external surface of the writing instrument 22. It has been found that even one coating of the varnish mixture cured to form a compressible polyurethane friction coating on the external housing of the writing instrument 22 of the present invention will increase the static coefficient of that surface. This is depicted in the test results shown in the graph in FIG. 8.

The varnish mixture of the present invention preferably is formed of 80–120 parts by volume of varnish mixed with 10–20 parts by volume of the hardener. Also thinner can be added preferably within the range of 15–40 parts thereof.

FIG. 8 is a table which illustrates the static coefficient of friction determined for pencil materials with selected coatings. The control material shown in the first line includes three separate specimens under control which is the base material of the writing instrument without any coating.

Coating A and Coating B immediately therebelow each include three separate specimens of the coating applied in accordance with the method of the present invention. As can be seen the static coefficient of friction of the uncoated control measurements is 0.306 to 0.364. On the other hand the static coefficient of the two different coatings applied in accordance with the present invention provide six measurements between 0.509 and 0.601. From the comparison to the control we can see that the static coefficient greatly increases to a value above 0.500 by the application of a coating of the varnish mixture in accordance with the present invention. An accepted standard for non-slip flooring is 0.500 static friction. As such, the writing instruments manufactured in accordance with the method of the present invention can be defined as including a "non-slip" grasping surface.

FIG. 9 illustrates a graph showing the compressibility of the uncoated control substrate shown by the line connecting square points. As compared to the singly coated substrate as shown by the line connecting the triangles compared to the doubly coated substrate showing the line connecting the circular points.

This graph is a result of tests performed for the purpose of determining the compressibility of the surface. These tests were performed by placement of a 0.125 inch steel bearing in contact with the grasping surface. Pressure was applied downwardly from the bearing normal to the surface of the writing instrument to determine the amount of pressure required for compressing of this surface. Pressure was increased until the penetration depth equaled 0.007 inches. The graph is FIG. 9 depicts the penetration or deflection in inches on the horizontal abscissa resulting from the application of a low pressure in pounds indicated by the vertical ordinant. Therefore the higher the line in this graph the harder the material and the less compressible. The most compressible material would have the lowermost line. This is indeed the result which was obtained. It was required to apply a pressure of approximately three and one-half pounds in order to achieve a penetration of 0.007 inches in the uncoated substrate. On the other hand less than three pounds of pressure was required in order to penetrate the same distance on a singly coated substrate and only approximately one and one-half pounds was required to penetrate 0.007 inches in the doubly coated substrate. This graph clearly shows that the grasping surface of the writing instrument 22 is more compressible resulting from one or more coatings applied in accordance with the method of the present invention.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A method for making a writing instrument with a resiliently compressible friction coating thereon comprising:

A. providing of a writing instrument with an external housing and a writing medium positioned internally therewithin;

B. mixing of a varnish and a hardener component to make a fluid varnish mixture;

C. applying of a coating of the varnish mixture onto the external housing of the writing instrument to a thickness of 0.002 to 0.009 inches to form a resiliently compressible friction coating of polyurethane thereon; and D. curing of the varnish coating to form a polyurethane friction coating which is resiliently compressible on the external housing of the writing instrument.

2. The method for making of a writing instrument with a resiliently compressible friction coating thereon as defined in claim 1 wherein the providing of a writing instrument is performed with an external housing of plastic.

3. The method for making of a writing instrument with a resiliently compressible friction coating thereon as defined in claim 1 further comprising bonding of the varnish coating to the external housing of the writing instrument by chemical adherence therebetween.

4. The method for making of a writing instrument with a resiliently compressible friction coating thereon as defined in claim 1 wherein the providing of a writing instrument comprises providing of a pencil with a wooden external housing.

5. The method for making of a writing instrument with a resiliently compressible friction coating thereon as defined in claim 1 wherein the providing of a writing instrument comprises providing of a pen with a plastic external housing.

6. The method for making of a writing instrument with a resiliently compressible friction coating thereon as defined in claim 1 wherein the applying of a coating of the varnish mixture is performed by spraying of a coating of the varnish mixture onto the outside of the external housing of the writing instrument.

7. The method for making of a writing instrument with a resiliently compressible friction coating thereon as defined in claim 1 wherein the curing of the varnish coating comprises air drying thereof.

8. The method for making of a writing instrument with a resiliently compressible friction coating thereon as defined in claim 7 wherein the air drying is performed at ambient room temperature for approximately twenty four hours.

9. The method for making of a writing instrument with a resiliently compressible friction coating thereon as defined in claim 1 wherein the curing of the varnish coating includes heating of the varnish coating.

10. The method for making of a writing instrument with a resiliently compressible friction coating thereon as defined in claim 9 wherein heating of the varnish coating includes exposing of the varnish coating to infrared radiation.

11. The method for making of a writing instrument with a resiliently compressible friction coating thereon as defined in claim 9 wherein heating includes applying of heat to the varnish coating for approximately five minutes at 80 to 85 degrees Centigrade.

12. The method for making of a writing instrument with a resiliently compressible friction coating thereon as defined in claim 1 wherein curing of the varnish coating includes evaporating of aromatic solvents from within the applied varnish mixture.

13. The method for making of a writing instrument with a resiliently compressible friction coating thereon as defined in claim 12 wherein the curing of the varnish coating includes evaporating of xylol therefrom.

14. The method for making of a writing instrument with a resiliently compressible friction coating thereon as defined in claim 1 wherein mixing is performed with a varnish which is chosen from the family of polyester elastomeric materials.

15. The method for making of a writing instrument with a resiliently compressible friction coating thereon as defined in claim 1 wherein the mixing is performed with a varnish which includes esters therein.

16. The method for making of a writing instrument with a resiliently compressible friction coating thereon as defined in claim 1 wherein the mixing is performed with a varnish which includes aromatic solvents therein.

17. The method for making of a writing instrument with a resiliently compressible friction coating thereon as defined in claim 1 wherein the mixing is performed with a varnish which includes xylol therein.

18. The method for making of a writing instrument with a resiliently compressible friction coating thereon as defined in claim 1 wherein the mixing is performed with a hardener which is chosen from the family of polyisocyanates.

19. The method for making of a writing instrument with a resiliently compressible friction coating thereon as defined in claim 1 wherein the mixing is performed with a hardener which includes an ester component therein.

20. The method for making of a writing instrument with a resiliently compressible friction coating thereon as defined in claim 1 wherein the mixing is performed with a hardener having less than 0.9% of free monomers.

21. The method for making of a writing instrument with a resiliently compressible friction coating thereon as defined in claim 1 further comprising thinning of the mixture of hardener and varnish by mixing thereof with a thinner containing aromatic solvents and esters to facilitate applying thereof onto the external housing of the writing instrument.

22. The method for making of a writing instrument with a resiliently compressible friction coating thereon as defined in claim 1 further comprising mixing of the varnish mixture with a matting additive to facilitate forming of a compressible polyurethane friction coating having an external matt finish thereon.

23. The method for making of a writing instrument with a resiliently compressible friction coating thereon as defined in claim 1 further comprising adding of a pigment component to the varnish mixture prior to applying thereof for facilitating coloration of the compressible polyurethane coating on the outer surface of the external housing of the writing instrument.

24. The method for making of a writing instrument with a resiliently compressible friction coating thereon as defined in claim 1 wherein curing of the varnish coating forms a compressible polyurethane friction coating on the external housing having a compressibility greater than the compressibility of the external housing.

25. The method for making of a writing instrument with a resiliently compressible friction coating thereon as defined in claim 1 wherein curing of the varnish coating forms a compressible polyurethane friction coating with a friction resistance of greater than 0.500.

26. The method for making of a writing instrument with a resiliently compressible friction coating thereon as defined in claim 1 wherein mixing of the varnish mixture is performed with 80 to 120 parts by volume of varnish mixed with 10 to 20 parts by volume of hardener.

27. The method for making of a writing instrument with a resiliently compressible friction coating thereon as defined in claim 26 wherein the mixing further includes adding 15 to 40 parts by volume of thinner to the varnish mixture.

28. The method for making of a writing instrument with a resiliently compressible friction coating thereon as defined in claim 1 further comprising:

A. applying of a second coating of the varnish mixture onto the external housing of the writing instrument; and B. curing of the second varnish coating to form a second compressible polyurethane friction coating on the external housing of the writing instrument extending over the first varnish coating applied thereon.

29. A method for making a writing instrument with a resiliently compressible friction coating thereon comprising:

A. providing of a writing instrument with an external housing and a writing medium positioned internally therewithin;

B. mixing of a fluid varnish mixture including:

(1) a varnish of 80 to 120 parts by volume including aromatic solvents, esters and matting agents;

(2) a hardener component of 10 to 20 parts by volume including esters and polyisocyanates and under 0.9% free monomers; and (3) a thinner of 15 to 40 parts by volume including aromatic solvents and esters;

C. spraying of a coating of the varnish mixture to a thickness of between 0.002 and 0.009 inches onto the external housing of the writing instrument to form a resiliently compressible friction coating of polyurethane thereon; and D. curing of the varnish coating to form a polyurethane friction coating which is resiliently compressible and in chemical adherence with the external housing of the writing instrument by allowing evaporation of the aromatic solvent xylol from the varnish coating.

30. A writing instrument having a resiliently compressible friction coating thereon to facilitate grasping and use thereof comprising:

A. a housing means defining a bore means extending longitudinally therethrough, one end of said bore means defining an end opening therein;

B. a writing medium positioned within said bore means and extending to said end opening thereof; and C. a resiliently compressible friction coating cured on said housing means by applying of a mixture of a varnish and a hardener component thereon to a thickness of 0.002 to 0.009 inches to facilitate resilient compressibility thereof.

31. A writing instrument having a resiliently compressible friction coating thereon to facilitate grasping and use thereof as defined in claim 30 wherein said housing means is tubular shaped and said bore means extends axially therewithin.

32. A writing instrument having a resiliently compressible friction coating thereon to facilitate grasping and use thereof as defined in claim 30 wherein said housing means is made of wood.

33. A writing instrument having a resiliently compressible friction coating thereon to facilitate grasping and use thereof as defined in claim 30 wherein said housing means is made of plastic.

34. A writing instrument having a resiliently compressible friction coating thereon to facilitate grasping and use thereof as defined in claim 30 wherein said writing medium comprises pencil graphite.

35. A writing instrument having a resiliently compressible friction coating thereon to facilitate grasping and use thereof as defined in claim 30 wherein said compressible friction coating has a higher coefficient of friction than said housing means.

36. A writing instrument having a resiliently compressible friction coating thereon to facilitate grasping and use thereof as defined in claim 30 wherein said compressible friction coating is compressible inwardly toward said bore means defined within said housing means.

37. A writing instrument having a resiliently compressible friction coating thereon to facilitate grasping and use thereof as defined in claim 30 wherein said compressible friction coating is cured on said housing means by air drying thereof for approximately five hours.

38. A writing instrument having a resiliently compressible friction coating thereon to facilitate grasping and use thereof as defined in claim 30 wherein said compressible friction coating is cured on said housing means by application of heat thereto.

39. A writing instrument having a resiliently compressible friction coating thereon to facilitate grasping and use thereof as defined in claim 30 wherein said compressible friction coating includes a matt external finish thereon.

40. A writing instrument having a resiliently compressible friction coating thereon to facilitate grasping and use thereof as defined in claim 30 wherein said compressible friction coating includes pigments therein for coloration thereof.

41. A writing instrument having a resiliently compressible friction coating thereon to facilitate grasping and use thereof as defined in claim 30 wherein said compressible friction coating is formed by spraying of a mixture of 80 to 120 parts by volume of a varnish with 10 to 20 parts by volume of a hardener and 15 to 40 parts by volume of a thinner onto said housing means.

42. A writing instrument having a resiliently compressible friction coating thereon to facilitate gasping and use thereof as defined in claim 41 wherein the varnish includes aromatic solvents and esters.

43. A writing instrument having a resiliently compressible friction coating thereon to facilitate grasping and use thereof as defined in claim 41 wherein the hardener component includes esters and polyisocyanates and under 0.9% free monomers.

44. A writing instrument having a resiliently compressible friction coating thereon to facilitate grasping and use thereof as defined in claim 30 wherein said compressible friction coating has a coefficient of static friction of greater than 0.500.

45. A writing instrument having a resiliently compressible friction coating thereon to facilitate grasping and use thereof as defined in claim 30 wherein said compressible friction coating comprises a compressible polyurethane friction coating.

46. A writing instrument having a resiliently compressible friction coating thereon to facilitate grasping and use thereof as defined in claim 30 wherein said compressible friction coating is cured on said housing means by spraying of a mixture of a varnish and a hardener component thereon.

47. A writing instrument having a resiliently compressible friction coating thereon to facilitate grasping and use thereof as defined in claim 30 wherein said compressible friction coating comprises a first compressible coating and wherein said writing instrument further includes a second compressible friction coating cured on said housing means by applying of a mixture of a varnish and a hardener component thereon over said first compressible friction coating.

48. A writing instrument having a resiliently compressible friction coating thereon to facilitate grasping and use thereof comprising:

A. a housing means being tubularly shaped and defining a bore means extending longitudinally and axially therethrough, one end of said bore means defining an end opening therein;

B. a writing medium positioned within said bore means and extending to said end opening thereof; and C. a resiliently compressible polyurethane friction coating cured on said housing means by spraying thereon of a mixture of a varnish, including aromatic solvents and esters, and a hardener component, including esters and polyisocyanates and under 0.9% free monomers, to a thickness of approximately 0.002 to 0.009 inches, said resiliently compressible polyurethane friction coating having a static coefficient of friction of greater than 0.500 and said housing means having a static coefficient of friction of less than 0.500, said resiliently compressible polyurethane friction coating being more compressible than said housing means.

* * * * *